US006200636B1

(12) United States Patent
van Ooij et al.

(10) Patent No.: US 6,200,636 B1
(45) Date of Patent: Mar. 13, 2001

(54) FLUXING PROCESS FOR GALVANIZATION OF STEEL

(75) Inventors: Wim J. van Ooij, Fairfield; Prasanna Vijayan, Cincinnati, both of OH (US)

(73) Assignee: The University of Cincinnati, Cincinnati, OH (US)

( * ) Notice: Subject to any disclaimer, the term of this patent is extended or adjusted under 35 U.S.C. 154(b) by 0 days.

(21) Appl. No.: 09/375,802

(22) Filed: Aug. 17, 1999

Related U.S. Application Data

(63) Continuation-in-part of application No. 09/136,753, filed on Aug. 19, 1998, now abandoned.

(51) Int. Cl.[7] ..... B05D 1/18; B05D 1/36

(52) U.S. Cl. ..... 427/313; 427/312; 427/328; 427/405; 427/406; 427/433; 427/437; 427/438; 427/443.1

(58) Field of Search ..... 427/312, 313, 427/328, 405, 406, 433, 437, 438, 443.1

(56) References Cited

U.S. PATENT DOCUMENTS

| | | | | |
|---|---|---|---|---|
| 3,870,526 | * | 3/1975 | Pearlstein et al. | 106/1 |
| 4,027,055 | | 5/1977 | Schneble, Jr. | 427/98 |
| 4,093,466 | * | 6/1978 | Davis | 106/1.22 |
| 4,285,995 | * | 8/1981 | Gomersall | 427/383.9 |
| 4,505,958 | * | 3/1985 | Lieber et al. | 427/433 |
| 4,618,513 | * | 10/1986 | Kinkelaar et al. | 427/443.1 |
| 4,954,184 | | 9/1990 | Conn | 148/24 |
| 5,292,377 | | 3/1994 | Izeki et al. | 148/23 |

FOREIGN PATENT DOCUMENTS

| | | | |
|---|---|---|---|
| 1502673 | 3/1978 | (GB) . | |
| 01290944 | 12/1998 | (IT) . | |
| 04157146 | 5/1992 | (JP) | 2/28 |
| 05117835 | 5/1993 | (JP) | 2/30 |
| 05148602 | 6/1993 | (JP) | 2/2 |
| 05195179 | 8/1993 | (JP) | 2/2 |
| 07233459 | 9/1995 | (JP) | 2/30 |

* cited by examiner

*Primary Examiner*—Shrive Beck
*Assistant Examiner*—Michael Barr
(74) *Attorney, Agent, or Firm*—Frost Brown Todd LLC

(57) ABSTRACT

An improved fluxing method for the galvanization of steel, particularly batch galvanization, is disclosed. In this process, a metallic element is deposited (for example, by electroless plating) on the surface of the steel sheet or other article prior to its being dipped in the galvanization bath. Preferred metals for use in this fluxing process are tin, copper, nickel, with tin being more preferred, and mixtures of copper and tin being most preferred. This metallic film layer has a thickness between about 5 and about 50 nm. The process of the present invention provides a number of benefits when compared to conventional fluxing processes: for example, it is compatible with the inclusion of aluminum in the galvanization bath; it permits a greater time delay between the fluxing and galvanization operations; and it eliminates the formation of hydrogen chloride or other toxic fumes when the fluxed article is dipped in the molten zinc galvanization bath. Additionally, the present process permits the combination of the fluxing and pickling steps into a single step, providing a shorter and more efficient galvanization process than is conventionally used. The fluxing method may also be used in a continuous galvanization process.

34 Claims, No Drawings

FLUXING PROCESS FOR GALVANIZATION OF STEEL

This application is a continuation-in-part, of U.S. patent application Ser. No. 09/136,753; van Ooij and Vijayan, filed Aug. 19, 1998 now abandoned.

TECHNICAL FIELD

The present invention relates to processes for the galvanization of steel, particularly batch hot-dip galvanization. Specifically, the present invention relates to improvements in the flux process used prior to the galvanization of steel.

BACKGROUND OF THE INVENTION

The importance of providing protection against corrosion for steel articles used outdoors (such as fences, garbage cans, and automobile parts) is obvious, and coating the steel with zinc is a very effective and economical means for accomplishing this end. Zinc coatings are commonly applied by dipping or passing the article to be coated through a molten bath of the metal. This operation is termed "galvanizing," "hot galvanizing" or "hot-dip galvanizing" to distinguish it from zinc electroplating processes. The steel galvanizing process is very well-known in the art and, for example, is discussed in detail in *The Making, Shaping, and Treating of Steel*, United States Steel Corporation, $7^{th}$ Edition, Pittsburgh, 1957, pages 660–673, and the $10^{th}$ edition, Lankford et al. (eds.), Association of Iron and Steel Engineers, Pittsburgh, 1985, pages 1173–1189, incorporated herein by reference. Galvanization processes generally fall into one of two types: batch hot-dip galvanizing, which is the hot-dip galvanizing of pre-formed articles by passing them one by one and in close succession through the molten zinc, and (2) continuous (strip) hot-dip galvanizing, in which steel in coiled form from the rolling mills is uncoiled and passed continuously through the galvanizing equipment, continuity of operation being achieved by joining the trailing end of one coil to the leading end of the next.

Batch galvanizing is an old and well-known process, having been practiced for over 200 years. The basic steps in the batch galvanizing process include: alkaline or acid degreasing followed by pickling (usually in hydrochloric acid or sulfuric acid) to remove rust and clean the surface of the steel; fluxing to protect the active surface of the steel from oxidation and to improve the wetting of the steel surface by molten zinc in the galvanization step; and dipping the steel in a bath of molten zinc. Continuous galvanization is similar, except that fluxing is typically not included since there is generally no significant delay before the prepared steel is dipped in the molten zinc. Alternatively, in a continuous galvanization process, the steel may be placed in a furnace and subjected to a reducing atmosphere prior to dipping in the molten zinc. Batch galvanization and continuous galvanization have some other very significant differences:

(1) The steel article or sheet is dipped in the molten zinc for a much longer time in batch galvanization (three minutes, as compared with about ten seconds in a continuous process);
(2) The batch process forms zinc iron alloys at the steel surface, while the continuous process generally does not;
(3) Galvanized steel from a batch process generally cannot be deformed significantly, while the product from a continuous galvanization process generally can (requiring that batch galvanized items generally be formed prior to galvanization);

(4) The thickness of the film formed in batch galvanization is about 75 $\mu$m, while the film formed in the continuous galvanization process is only about 20 $\mu$m; and
(5) The steel sheets used in continuous galvanization are generally thinner than those used in batch galvanization.

Flux protects the steel surface from oxidation during any delay prior to the time the steel object is dipped in the molten zinc galvanizing tank. Flux is typically used in a batch galvanization process but not in a continuous process, since either there is little or no delay prior to the galvanization step in a continuous process or, alternatively, the sheet is deoxidized in a reducing atmosphere. Essentially one type of flux is currently used in industrial galvanization. In this conventional flux process, the steel sheet or object is dipped in an aqueous solution containing ammonium chloride and zinc chloride. This forms a zinc ammonium chloride film on the surface of the object or sheet. Even if the specific compounds used in the flux process are varied, they generally contain chloride salts. While this process does prevent oxidation of the steel surface, it also presents some significant problems:

(1) While the operable time window between surface cleaning and the galvanization step is extended using the flux, that interval before oxidation begins is still relatively short (about two hours);
(2) Dipping the fluxed article in the molten zinc bath produces hydrogen chloride and other toxic fumes; and
(3) While it is desirable to include aluminum in the zinc bath in order to provide an anti-corrosion benefit to the galvanized coating, the chloride in conventional flux reacts with aluminum in the zinc bath, rendering the galvanization process ineffective.

The basic galvanization process, as well as a variety of attempts to address the problems associated with conventional fluxes, discussed above, are well-known in the art and exemplified by the following references.

*The Making, Shaping and Treating of Steel*, United States Steel Corporation, $7^{th}$ Edition, 1957, Pittsburgh, Chapter 39, pages 660–673, and the $10^{th}$ edition, Lankford et al. (eds.), Association of Iron and Steel Engineers, Pittsburgh, 1985, pages 1173–1189, contains a description of galvanization and the conventional processes used to galvanize steel.

Japanese Published Patent Application 07/233,459 (Toho AEN KK), published Sep. 5, 1995, describes a flux which comprises an aqueous solution of tin chloride and ammonium acetate. The flux is taught to be used prior to the galvanization of wires in a zinc-aluminum bath.

Japanese Published Patent Application 05/195,179 (Fuji Kogyo KK), published Aug. 3, 1993, describes a flux solution used for hot-dip zinc-aluminum galvanization, comprising an aqueous solution of $MnCl_2.4H_2O$, zinc chloride, tin chloride and potassium formate.

Japanese Published Patent Application 05/148,602 (Fuji Kogyo KK), published Jun. 15, 1993, describes a flux solution used in a zinc-aluminum galvanizing process, comprising zinc chloride, tin chloride, potassium formate and hydrochloric acid in an aqueous solution.

Japanese Published Patent Application 05/117,835 (Sumitomo Metal Mining Co./Tanaka AEN Metsuki KK), published May 14, 1993, describes a flux, used in a hot-dip galvanizing process, comprising an aqueous solution of ammonium chloride, zinc chloride, bismuth chloride or stannous chloride, together with an alcohol.

Japanese Published Patent Application 04/157,146 (Sumitomo Metal Mining Co.), published May 29, 1992, describes a flux used for hot-dip zinc-aluminum galvanization, comprising zinc chloride, tin chloride, and the chloride of at least one alkaline metal element.

Although the two process are completely different, it should be noted for the sake of completeness that tin is known for use as a component of soldering flux, see, for example, U.S. Pat. No. 4,954,184 (Day Manufacturing Company, Inc.), issued Sep. 4, 1990.

British Patent 1,502,673 (BASF), issued Mar. 1, 1998, describes an aqueous flux, which gives off only low levels of fumes and smoke when used prior to hot-dip zinc galvanization, comprising zinc chloride, potassium chloride, and optionally components selected from sodium chloride, ammonium chloride and aluminum chloride.

U.S. Pat. No. 5,292,377, Izeki, et al. (Tanaka Galvanizing Co./Sumitomo Metal Mining Co.), issued Mar. 8, 1994, describes a process for galvanizing steel with a zinc/aluminum coating to enhance the corrosion resistance of the finished product. This process is an adaptation of the conventional fluxing process to try to make it compatible with the inclusion of aluminum in the zinc bath. Specifically, the flux comprises zinc chloride or stannous chloride, together with an alkaline metal or alkaline earth metal chloride and an alkyl quaternary ammonium salt or alkyl amine.

It should be noted that none of the references, discussed above, teaches the deposition of a metallic element, particularly tin, or a mixture of copper and tin, on a steel article for use as a flux prior to galvanization.

U.S. Pat. No. 4,505,958, Lieber et al. (Hermann Huster GmbH & Co.), issued Mar. 19, 1982, describes a process for hot dip galvanizing workpieces of steel or iron materials wherein treatment with a fluxing agent is omitted. After being cleaned, the workpieces are coated with a metal layer, comprising aluminum, lead, cadmium, copper, nickel, bismuth, zinc, tin, and alloys of these metals. This layer replaces the previously customarily applied fluxing agent layer and are the steel or iron materials are subsequently immersed into zinc melt with their surfaces in a dry state.

It should be noted the metal layer deposited onto the steel surface in Lieber et al. is thicker (i.e. about 100–120 nm) than that of the preferred embodiment of the present invention, which is from about 5 to about 50 nm. This tends to result in irregularities in the zinc coating formed in Lieber et. al. Additionally, Lieber et al. does not disclose the use of a mixture of copper and tin (i.e. a non-alloy) as a flux to coat the metal surface prior to galvanization.

U.S. Pat. No. 4,285,995, Gomersall (Inland Steel Co.), issued Aug. 25, 1981, describes a method of increasing the rate of formation of zinc-iron alloy when hot-dip galvanizing a ferrous metal strip to effect complete alloying of the hot-dip zinc coating on at least one side of the strip. In this method, at least one lateral surface of the ferrous strip is coated with metallic copper, which is then heated in a non-oxidizing atmosphere to a temperature sufficient to diffuse a portion of the copper coating into the ferrous metal strip and thereafter hot-dip galvanizing the strip.

It should be noted that Gomersall does not teach the use of a mixture of copper and tin to coat the steel surface prior to galvanization and Gomersall also requires heating the coated surface prior to galvanization wherein the present invention does not require this step.

It has now surprisingly been found that if a very thin metallic film, such as tin metal or, more preferably, a metallic film constituting a mixture of copper and tin, is deposited on a steel article (or sheet) as a flux, prior to galvanization, a number of significant benefits are realized:

(1) The fluxed article is compatible with the use of aluminum in the molten zinc galvanizing bath;
(2) A much longer delay (up to five, or even ten, days) is possible between the fluxing operation and the galvanization of the article;
(3) No hydrogen chloride or other toxic fumes are formed when the article is dipped in the molten zinc galvanizing bath;
(4) The fluxing process is inexpensive and provides good strong alloy coatings on the article;
(5) The fluxing process is robust, operating effectively under a wide range of processing conditions;
(6) The fluxing process appears to make galvanization less sensitive to the silicon content of the article being galvanized (i.e., the so-called Sandelin effect is minimized); and
(7) The present invention allows the pickling step and the fluxing step to be combined into a single step thereby significantly simplifying the galvanization process.

The present invention, its variations and its many benefits are described in greater detail below.

SUMMARY OF THE INVENTION

The present invention defines an improvement in the steel galvanizing process comprising the formation on the surface of the steel being galvanized of a layer of metal prior to the dipping of said steel into the galvanizing bath. It is preferred that the present invention be utilized in the context of a batch hot-dip galvanization process and that the metal layer be deposited on the steel surface using an electroless plating process. Metal layers having a thickness of from about 5 to about 50 nm provide the best galvanization results. The preferred metals for use in the present invention include tin, copper, nickel, cobalt, manganese, zirconium, chromium, lead, silver, gold, platinum, palladium, mercury and molybdenum, as well as mixtures of those metals. Particularly preferred metals are tin, copper and nickel, with tin being more preferred, and mixtures of copper and tin being most preferred.

The present invention also encompasses a process for preparing a steel article for batch hot-dip galvanization comprising the steps of:

(a) degreasing said steel article by dipping it in an alkaline solution;
(b) pickling said steel article by dipping it in an acid solution; and
(c) fluxing said steel article by electroless plating on the surface of said steel article a layer of a metal, particularly those metals described above.

In a preferred process, the steps just described are followed by the galvanization of the steel article by dipping it in a bath comprising molten zinc.

In addition to the above process, which utilizes separate pickling and fluxing steps, the present invention also encompasses a galvanization process wherein the pickling and the fluxing steps are combined. In this embodiment, the present invention encompasses a process of preparing a steel article for batch hot-dip galvanization comprising a combined pickling/fluxing step wherein a metal layer is electroless plated on the surface of said steel article from an acidic solution. The useful metals are those described above. This process is typically followed by a galvanizing step wherein the fluxed steel article is dipped in a bath comprising molten zinc.

All ratios and percentages given herein are "by weight", unless otherwise specified.

As used herein, the phrase "steel article" or "steel object" is intended to include, in addition to individual pre-formed steel articles, steel sheets which are to be galvanized. It is not intended to include steel strip.

DETAILED DESCRIPTION OF THE INVENTION

The present invention relates to an improvement in the fluxing step used in the galvanizing process for steel. Such galvanizing processes, in general, are well-known and fully described in the art; they consist generally of two types: continuous galvanization and batch galvanization. See, for example, *The Making, Shaping and Treating of Steel*, United States Steel Corporation, $7^{th}$ Edition, 1957, Pittsburgh, Chapter 39, pages 660–673, 1957, and the $10^{th}$ edition, Lankford et al. (eds.), Association of Iron and Steel Engineers, Pittsburgh, 1985, pages 1173–1189, incorporated herein by reference. The improvement of the present invention is useful in any galvanizing process, but is especially useful in batch galvanization processes for steel where there is frequently a significant time delay between the fluxing of an article and the actual galvanization of that article.

In a typical batch galvanization process, the surface of the article to be galvanized is treated to remove rust and other foreign materials, the article is then fluxed and, finally, it is dipped in molten zinc to provide the galvanization. The surface preparation steps (i.e., degreasing and pickling) utilized in the process of the present invention are conventional and are known in the art. The purpose of these steps is to remove rust and other foreign materials from the surface of the steel article. This is generally accomplished by a degreasing step (to remove organic contaminants from the steel surface) in which the article is dipped in a heated alkaline solution. In a typical degreasing step, the steel article is dipped for about 5 to about 60 minutes in an alkaline solution containing sodium hydroxide and sodium orthosilicate in a weight ratio of about 1:1, and a concentration of 10 to 15%, at a temperature of about 60° C. to about 80° C. Other alkaline materials, such as potassium hydroxide, can be used. Alternatively, the steel article can also be degreased in an acid solution using a mixture of phosphoric, hydrochloric and sulfuric acids. After this degreasing step is completed, the steel article is generally rinsed with water to remove the alkaline solution and any foreign substances (e.g., dirt and other organic particles) sticking to its surface.

This is typically followed by a pickling step (to remove mill scale and rust from the steel surface) wherein the steel article is dipped in an acid solution, preferably one containing hydrochloric acid or sulfuric acid. Pickling for sheet galvanizing is usually conducted as a batch operation in stationary tubs provided with an agitating means. This operation may sometimes be conducted as a continuous process in equipment provided with a sheet conveyor and means for electrolytic acceleration. Very light pickling, requiring only a short time exposure to the pickling solution, has been found suitable for products, such as roofing and siding, that require little mechanical deformation. Deep etching (i.e., heavy pickling) of the base metal has generally been found to be necessary when forming requirements are severe. The pickling is generally accomplished by dipping the article for as long as 5 to 30 minutes in a 10 to 15% aqueous solution of sulfuric acid (or hydrochloric acid), containing about 0.5% to about 0.7% of a pickling inhibitor, at room temperature or a temperature of about 50° C. to about 70° C. Higher bath temperatures require shorter immersion times. Typically, after the pickling step is concluded, the article is rinsed with water to remove excess pickling solution and iron salts sticking to the steel surface. The result of these processes is an object having a very active surface, since all the rust and other foreign materials have been removed, making it highly susceptible to oxidation.

The fluxing step protects the surface of the steel article from oxidation until it is galvanized. The improved fluxing step described herein is the heart of the present invention. Thus, rather than depositing a chloride salt on the surface of the article, as would be done using the conventional fluxing process, the present invention deposits a layer of a metallic element or elements, on the steel surface. The thickness range of this metal layer is from about 1 nm to about 10 $\mu$m, preferably from about 1 nm to about 100 nm, and most preferably from about 5 to about 50 nm. A steel article, fluxed to provide a metal layer with a thickness of from about 5 to about 50 nm on to its surface, generally galvanizes uniformly with no bare spots, bristles or other defects. If the flux layer has a thickness much less than this, the protective properties of the flux layer are diminished, resulting in a patchy flux layer, which can give rise to bare (ungalvanized) spots on the steel surface. On the other hand, steel articles having a flux layer thickness of about 100 nm or greater can cause rough galvanized coatings having bristles and other irregularities.

Any method of depositing the metal on the steel surface may be used in the process of the present invention. However, electroless plating is the preferred deposition method. Electroless plating is a process well-known in the art and is described, for example, in Lowenheim (ed), *Modern Electroplating,* 3rd edition, 1974, John Wiley & Sons, New York, incorporated herein by reference. In it, the metal is plated out onto the steel surface from a solution containing a reducing agent. When electroless plating is used as the deposition method on steel, any metal which is galvanically more noble than iron may be used in the fluxing process of the present invention, i.e., any metal that can be deposited on the steel surface by electroless plating can be used. Examples of such metals include tin, copper, nickel, cobalt, manganese, zirconium, chromium, lead, mercury, gold, silver, platinum, palladium, molybdenum and mixtures thereof. Aluminum and zinc, for example, cannot be electroless plated onto steel and, therefore, cannot be used as fluxes in the present invention. Preferred metals from this group are those which are relatively inexpensive, non-toxic and commercially available. These include tin, copper and nickel. Tin, and especially mixtures of copper and tin, are particularly preferred since these metals meet all of the above criteria and do not negatively interact with the steel when they are applied.

In the electroless plating process, tin or another appropriate metal is deposited from an appropriate salt out of an aqueous solution having an acidic pH. This process is well-known in the art and is described, for example, in Lowenheim (ed), *Modern Electroplating*, cited above, see especially pages 412–415, incorporated herein by reference. In this process, the metal is deposited from its salt on the steel surface without the aid of an outside source of electric current or a chemical reducing agent in solution. The process is simple, requires only a small investment in equipment and permits the deposit of the metal in recesses on the article. The electroless plating of tin is generally carried out over a time period of from about 1 to about 10 minutes, preferably from about 1 to about 5 minutes, most preferably from about 1 to about 2 minutes; at a temperature of from about 50° C. to about 100° C., preferably from about 70° C. to about 80° C.; from an aqueous solution having pH of from about 0 to about 7, preferably from about 0 to about 4. Examples of salts which can be used to provide the metal in the electroless plating process include metal chlorides, acetates, sulfates and cyanates, with chlorides being preferred. It is preferred that the acidic pH of the fluxing solution be provided by hydrochloric acid and that the tin metal be provided by stannous chloride ($SnCl_2$), although any tin salt from which the tin will plate out on steel may be used. A particularly preferred aqueous solution for carrying out the fluxing process of the present invention includes from about 1% to about 15%, preferably about 5%, hydrochloric acid and from about 1% to about 25%, preferably about 10%, $SnCl_2.2H_2O$.

The electroless plating of mixtures of copper and tin is generally carried out over much shorter time periods, ranging from about 1 to about 100 seconds, preferably from about 1 to about 10 seconds; at a temperature of about 10° C. to about 30° C., preferably of about 15° C. to about 20° C.; from an aqueous solution having pH of from about 0 to about 7, preferably from about 0 to about 4. Because the fluxing time is short and conducted at room temperature, it is thought that the layer deposited on the steel is a mixture of copper and tin, not an alloy. Examples of copper and tin salts which can be used to provide the metal in the electroless plating process include metal chlorides, acetates, sulfates and cyanates, with chlorides being preferred. It is preferred that the acidic pH of the fluxing solution be provided by hydrochloric acid, that the copper metal be provided by cupric chloride ($CuCl_2$) and that the tin metal be provided by stannous chloride ($SnCl_2$).

The ratio of copper to tin (Cu:Sn) is important. The range of copper to tin ratios (by weight) that results in acceptable galvanized coatings is from about 1 part copper, 40 parts tin (1:40) to about 1 part copper, 10 parts tin (1:10); and is preferably about 1 part copper, 20 parts tin (1:20). The use of a combined acid and copper/tin bath takes advantage of the synergistic effect between the copper and tin. It has been found that the addition of a small amounts of copper to the acidic tin bath accelerates the flux metal deposition rate. Hence, the necessity of a heated flux bath is eliminated, thereby decreasing operating costs and also decreasing the amount of noxious HCl vapors generated in this process. It should be noted that a pure copper bath is less desirable since the coating deposition rate of copper metal is fast and difficult to control, and can result in thick flaky copper coatings on the steel article. Such an article, on hot dip galvanization, yields poorly galvanized coatings. Thus, there is a marked preference for the inclusion of tin in the copper bath since it slows down and controls the deposition rate of the copper/tin metal layer.

The fluxing process of the present invention remains effective even as iron and zinc build up in the flux bath, as frequently happens as a bath is being used. Thus, the flux baths used in practicing the present invention may contain up to about 10% iron ($Fe^{3+}$) and up to about 3% zinc ($Zn^{2+}$).

The galvanizing step is well-known in the art. In this step, for example, the fluxed article is dipped into a molten zinc bath for about three minutes at a temperature of about 455° C. Typically, the residence time in the bath is from about 1 to about 15 minutes, preferably about 3 minutes, and the bath temperature is from about 445 to about 460° C. The equipment typically used for sheet galvanizing consists of mechanical facilities for transporting cut length sheets or other articles successively through acid washing, fluxing, hot-dipping, and cooling operations. The coating bath, itself, is contained in a heated low carbon steel vessel or pot. A framework or rigging, typically including suitable entry feed rolls, sheet guides, driven bottom pinch rolls, and driven exit rolls, is suspended in the bath in such a manner as to completely submerge all but the entry rolls, part of the exit rolls, and part of the supporting framework.

Small quantities of other metals may be added to the zinc bath to control the appearance and properties of the coatings formed. For example, lead, at low levels, can be used to produce a spangled finish on the galvanized product. Antimony can also be added in small amounts to assist in producing an attractive low relief spangle finish. Aluminum, at a level of between about 0.001% and 0.25%, increases the adherence of the galvanized coating to the steel sheet and increases the corrosion resistance of galvanized layer. The present invention is particularly useful because it permits the inclusion of aluminum in the zinc galvanizing bath. Conventional fluxing processes are incompatible with the use of aluminum in the galvanizing step, since those fluxing processes result in a chloride layer being formed on the fluxed steel, the chloride layer reacting negatively with aluminum in the galvanizing bath.

Another benefit of the present invention is that it permits the pickling and the fluxing steps to be combined into a single step thereby resulting in a galvanizing process which is much simpler than the current processes. This combination of steps is possible since acid, such as hydrochloric acid, is used in the pickling step and is also used to provide the acid pH in the fluxing step where a metal, such as tin or a copper/tin mixture is electroless plated on the steel article. Acids useful in this combined fluxing/pickling step include sulfuric acid, phosphoric acid, hydrochloric acid, and mixtures thereof, with hydrochloric acid being preferred since it is useful at lower temperatures. Preferred salts which may be used to deposit the metal on the steel article in the fluxing/pickling step include copper chloride, tin chloride, and mixtures thereof, although any of the salts discussed above may be used. A preferred aqueous solution for the combined fluxing/pickling step comprises from about 1% to about 15%, preferably about 10% HCl, and from about 1% to about 25%, preferably about 10%, $SnCl_2$. The precise amount of acid used is adjusted based on the amount of rust present on the steel articles. For example, if the steel articles are only lightly rusted, then a 5% HCl solution may be appropriate, while a 10% HCl solution may be required if the articles are more heavily rusted. When using only tin, the combined fluxing/pickling steps may be carried out for a time period of from about 1 to about 10 minutes, preferably from about 2 to about 5 minutes; at a temperature of from about 50 to about 100° C., preferably from about 70 to about 80° C.; from an aqueous solution having a pH from about 0 to about 7, preferably from about 0 to about 4. The immersion time in the combined fluxing/pickling step will also depend on the amount of surface rust on the article being treated.

Although the process of the present invention was developed for use in batch galvanization, it may also be advantageously used as part of a continuous galvanization process. While fluxing is frequently not necessary in a continuous process to protect the metal surface from oxidation, since a protective atmosphere is used to shield the metal surface, sometimes, in the absence of such atmosphere, flux is used to protect the metal surface from oxidation. In addition, flux can be used to activate the metal surface prior to immersion in the zinc bath. In that context, the process of the present invention provides the following advantages over conventional (e.g., zinc ammonium chloride) fluxes:

(1) the toxic fumes which are formed when the fluxed steel is dipped in the molten zinc are eliminated;
(2) a more uniform coating is formed in the galvanization process; and
(3) the steel strip may be heated to a higher temperature prior to being galvanized, thereby minimizing temperature loss of the zinc bath.

The fluxing process, when used in a continuous galvanization operation, is similar to the batch process described above, with some changes made to individual steps of the overall process. For example, the pickling step generally takes place for from about 3 to about 15 seconds in acid (generally hydrochloric or sulfuric acid) at a temperature of from about 40° C. to about 60° C. The fluxing step is generally carried out for from about 3 to about 14 seconds at a temperature ranging from room temperature to about 75° C. The flux, itself, may be any of the metals discussed above. However, preferred flux compositions comprise $SnCl_2$ (at the levels described above) together with from about 0% to about 20% by weight of the flux bath $CuCl_2$, more preferably 0–5% $CuCl_2$, by weight, and most preferably 0–2% $CuCl_2$, by weight. Thus, the preferred flux is a mixture of copper and tin. Finally, in a continuous process the immersion time for the steel strip in the zinc bath is for only a few seconds.

The following examples are intended to be illustrative of the processes of the present invention and are not intended to be limiting thereof.

EXAMPLE 1

The flux process of the present invention, used in a batch galvanization operation, is illustrated by the following example.

AISI 1018 hot rolled (3 mm thick) steel panels are degreased in 10 wt % NaOH solution heated to around 70° C. for about five minutes. The steel panels are then rinsed and pickled in 10 wt % HCl aqueous solution at room temperature for about 5 minutes. The aqueous flux bath is composed of 10 wt % $SnCl_2.2H_2O$ and 5 wt % HCl and is maintained at a temperature of 75° C. Pickled panels are immersed in the fluxing bath for 1 minute. The panels are then rinsed in water at room temperature for about one minute, and dried (hot blown air). The thickness of the flux layer is between about 5 and about 50 mm. The fluxed panels are hot dipped in a molten zinc bath maintained at 455° C. for 3 minutes. Panels are cooled in air. The panels are galvanized well with the surface showing bright spangles. Analysis of the alloy structure of the coating (cross-section, scanning electron microscopy (SEM) and energy dispersive x-ray analysis (EDX)) shows that the coating is essentially identical to that formed by conventional galvanizing processes.

EXAMPLE 2

The process of the present invention using a combined pickling/fluxing step in a batch galvanization operation is illustrated by the following example.

AISI 1018 hot rolled (3 mm thick) steel panels are degreased in 10 wt % NaOH solution heated to around 70° C. for about 5 minutes. The steel panels are then rinsed in water, at room temperature, for about one minute. The panels are immersed in the aqueous flux bath immediately. The aqueous flux bath is composed of 10 wt % $SnCl_2.2H_2O$ and 5 wt % HCl and is maintained at a temperature of 75° C. Degreased panels are immersed in the flux bath for 2 minutes. During this time, the steel surface is pickled and a thin tin film is deposited on it. The thickness of the flux layer is between about 5 and about 50 nm. The panels are then rinsed in water (room temperature for about 1 minute) and dried (hot blown air). The fluxed panels are hot dipped in a molten zinc bath maintained at 455° C. for 3 minutes. Panels are cooled in air. The panels have excellent galvanized surfaces exhibiting bright spangles. Analysis of the alloy structure of the coating formed (cross-section, SEM and EDX) shows that the coating is essentially identical to that formed by conventional galvanizing processes.

EXAMPLE 3

The process of the present invention using a combined pickling/fluxing step in a batch galvanization operation is illustrated by the following example.

Hot rolled AISI 1018 steel panels are exposed in a humidity chamber maintained at a relative humidity of 85% and 60° C. for a week. The panels become heavily rusted. The steel panels are degreased in 10 wt % NaOH solution heated between 65° C.–80° C. for about 5 minutes. The steel panels are then rinsed in water for a minute. The panels are immersed in the aqueous flux bath immediately. The aqueous flux bath is composed of 10 wt % $SnCl_2.2H_2O$ and 10 wt % HCl and is maintained at a temperature of 75° C. Degreased panels are immersed in the flux bath for 2 minutes. During this time, the steel surface is pickled and a thin tin film is deposited on it. The thickness of the flux layer is between about 5 and about 50 nm. The panels are then rinsed in water (room temperature for about one minute) and dried (hot blown air). The fluxed panels are hot dipped in a molten zinc bath maintained at 455° C. for 3 minutes. The panels have excellent galvanized surfaces exhibiting bright spangles. Analysis of the alloy structure of the coating by SEM and EDX shows that the coating is essentially identical to that formed by conventional galvanizing processes.

EXAMPLE 4

The benefits provided by the present invention in terms of protecting a treated steel surface from oxidation, when compared to a conventional flux, is illustrated by the following example.

Hot rolled AISI 1018 steel panels are degreased in 10 wt % NaOH solution heated between 65° C.–80° C. for about 5 minutes. The steel panels are then rinsed (water, one minute) and pickled in 10 wt % HCl aqueous solution at room temperatures for about 5 minutes. One set of pickled panels are simply set aside, a second set of panels are treated with zinc ammonium chloride flux and the third set are treated with the flux disclosed in the present application. The second set of panels are fluxed in a solution comprising 55 wt % $ZnCl_2$ and 45 wt % $NH_4Cl$, at a concentration of 500 g/l and at a temperature of 70° C. for a minute. The panels are then dried in hot blown air and set aside. The third set of panels are treated in an aqueous flux bath composed of 10 wt % $SnCl_2.2H_2O$ and 5 wt % HCl and maintained at a temperature of 75° C. The panels are immersed in the flux bath for 1 minute (the thickness of the flux layer is between about 5 and about 50 nm). The panels are then rinsed (room temperature water for about one minute), dried in hot blown air and set aside along with the other two sets. All the panels are shelved for 5 days each and then hot dipped in a molten zinc bath maintained at 455° C. for 3 minutes. The first two sets of panels have very poor galvanized coatings with bare patches and a rough surface. The third set of panels is galvanized well with the surface showing bright spangles. An SEM and EDX analysis of cross sections from the third set of panels (i.e., the present invention) shows the four alloy layers seen with conventional galvanizing processes.

EXAMPLE 5

The following example illustrates the application of the flux process of the present invention to conditions which simulate a continuous galvanization operation.

Hot rolled AISI 1018 steel panels are degreased in 10 wt % NaOH solution heated to between 65° C.–80° C. for about 5 minutes. The steel panels are then rinsed (water, one minute). They are pickled in a 10% HCl aqueous solution maintained at 50° C. for 15 secs. One set of pickled panels is treated with zinc ammonium chloride flux and the second set with the flux of the present invention. The first set of panels is fluxed in a solution comprising 55% $ZnCl_2$ and 45% $NH_4Cl$ at a concentration of 500 g/l and at a temperature of 75° C. for 13 secs. The second set of panels is treated in an aqueous flux bath composed of 10 wt % $SnCl_2.2H_2O$, 1 wt % $CuCl_2$ and 5 wt % HCl and maintained at room temperature for 13 secs, and then rinsed in water (the thickness of the flux layer is between about 5 and about 50 nm). All the panels are dried in a oven maintained at 145° C. for 45 secs. All the panels are then preheated in a temperature of 300–350° C. and immediately dipped in a molten zinc bath maintained at 455° C. for 3 minutes. In spite of the fact that the galvanization time was relatively long for a continuous process, the first set of panels has very poor galvanized coatings with bare patches. The second set of panels is galvanized well with the surface showing bright spangles.

EXAMPLE 6

The process of the present invention using a combined copper/tin flux in a batch galvanization operation is illustrated by the following example.

1018 hot rolled steel panels are degreased in 10 wt % NaOH solution heated between 65° C.–80° C. for about 5 minutes. The steel panels are then rinsed and pickled in 10% HCl aqueous solution at room temperature for about 5 minutes. The aqueous flux bath used is 1:20 Cu/Sn flux, which comprises of 10 wt % $SnCl_2.2H_2O$, 0.5 wt % $CuCl_2.2H_2O$ and 5 wt % HCl and is maintained at room temperature. Pickled panels are immersed in the fluxing bath for 5 seconds in order to deposit a composite Cu/Sn metallic thin film of about 50 nm thickness. The panels are then rinsed and dried. The fluxed panels are hot dipped in a molten zinc bath maintained at 455° C. for 3 minutes. The panels are galvanized well with complete coverage and no surface defects with the surface showing bright spangles. SEM/EDX analyses of cross-sections taken from the coating confirm the formation of a normal alloyed galvanized coating.

What is claimed is:

1. A process for fluxing and galvanizing steel comprising the steps of:

a. the electroless plating on the surface of said steel of a layer of a metal, wherein the metal is selected from the group consisting of tin, copper, nickel, cobalt, manganese, zirconium, chromium, lead, mercury, gold, silver, platinum, palladium, molybdenum and mixtures thereof, wherein the metal layer has a thickness of from about 5 nm to about 50 nm; and b. galvanizing said steel.

2. The process according to claim 1, carried out for a period of from about 1 second to about 10 minutes, at a temperature of from about 15° C. to about 100° C., in an aqueous solution having a pH of from about 0 to about 7.

3. The process according to claim 2 wherein the metal is selected from the group consisting of tin, copper and nickel, and mixtures thereof.

4. The process according to claim 3 wherein the metal is tin.

5. The process according to claim 4 wherein the metal layer is deposited from an aqueous solution comprising hydrochloric acid and stannous chloride.

6. The process according to claim 5 carried out for a period of from about 3 seconds to about 5 minutes, at a temperature of from about 20° C. to about 80° C., the aqueous solution having a pH of from about 0 to about 4.

7. A process for fluxing and galvanizing steel comprising the steps of:

a. electroless plating on the surface of said steel a layer of metal from a fluxing solution comprising a mixture of copper and tin, wherein the mixture of copper and tin in the fluxing solution is in a ratio of from about 1 part copper and about 10 parts tin, by weight, to about 1 part copper and about 40 parts tin, by weight; and b. galvanizing said steel.

8. The process according to claim 7, wherein the layer of copper and tin has a thickness of from about 1 nm to about 10 $\mu$m.

9. The process according to claim 8 carried out for a period of from about 1 second to about 100 seconds, at a temperature of from about 10° C. to about 30° C., in an aqueous solution having a pH of from about 0 to about 7.

10. The process according to claim 9 wherein the mixture of copper and tin is in a ratio of about 1 part copper and about 20 parts tin, by weight.

11. The process according to claim 9 wherein the metal layer is deposited from an aqueous solution comprising hydrochloric acid, cupric chloride and stannous chloride.

12. The process according to claim 11 carried out for a period of from about 1 second to about 10 seconds, at a temperature of from about 15° C. to about 20° C., in an aqueous solution having a pH of from about 0 to about 4.

13. A process for hot-dip batch galvanization of a steel article comprising the steps of:

(a) fluxing said steel article by electroless plating on the surface of said steel article a layer of a metal selected from the group consisting of tin, copper, nickel, cobalt, manganese, zirconium, chromium, lead, mercury, gold, silver, platinum, palladium, molybdenum and mixtures thereof, wherein the metal layer has a thickness of from about 5 nm to about 50 nm; and (b) galvanizing said steel article by dipping it in a bath comprising molten zinc.

14. The fluxing process according to claim 13, carried out for a period of from about 1 second to about 10 minutes, at a temperature of from about 15° C. to about 100° C. in an aqueous solution having a pH of from about 0 to about 7.

15. The process according to claim 14 wherein the metal is selected from the group consisting of tin, copper and nickel, and mixtures thereof.

16. The process according to claim 14 wherein the prepration of said steel article for fluxing and batch hot-dip galvanization comprises the steps of:

(a) degreasing said steel article by dipping it in alkaline solution; and (b) pickling said steel article by dipping it in acid solution.

17. The process according to claim 15 wherein the metal is tin.

18. The process according to claim 17 wherein the metal layer is deposited from an aqueous solution comprising hydrochloric acid and stannous chloride.

19. The fluxing process according to claim 18 carried out for a period of from about 3 seconds to about 5 minutes, at a temperature of from about 20° C. to about 80° C., the aqueous solution having a pH of from about 0 to about 4.

20. A process for hot-dip batch galvanization of a steel article comprising the steps of:

(a) fluxing said steel article prior to galvanization comprising the electroless plating on the surface of said article of a layer of metal from a fluxing solution comprising a mixture of copper and tin, wherein the mixture of copper and tin in the fluxing solution is in a ratio of from about 1 part copper and about 10 parts tin, by weight, to about 1 part copper and about 40 parts tin, by weight; and (b) galvanizing said steel article by dipping it in a bath comprising molten zinc.

21. The process according to claim 20 wherein the layer of copper and tin has a thickness of from about 1 nm to about 10 $\mu$m;

22. The fluxing process according to claim 21 carried out for a period of from about 1 second to about 100 seconds, at a temperature of from about 10° C. to about 30° C., in an aqueous solution having a pH of from about 0 to about 7.

23. The process according to claim 22 wherein the mixture of copper and tin is in a ratio of about 1 part copper and about 20 parts tin, by weight.

24. The process according to claim 22 wherein the preparation of said steel article for fluxing and batch hot-dip galvanization comprises the steps of:

(a) degreasing said steel article by dipping it in alkaline solution; and (b) pickling said steel article by dipping it in acid solution.

25. The process according to claim 22 wherein the metal layer is deposited from an aqueous solution comprising hydrochloric acid, cupric chloride and stannous chloride.

26. The fluxing process according to claim 25 carried out for a period of from about 1 second to about 10 seconds, at a temperature of from about 15° C. to about 20° C., in an aqueous solution having a pH of from about 0 to about 4.

27. A process for a continuous galvanization comprising the steps of:

(a) fluxing a steel strip by electroless plating on the surface of said steel strip a layer of a metal selected from the group consisting of tin, copper, nickel, cobalt, manganese, zirconium, chromium, lead, mercury, gold, silver, platinum, palladium, molybdenum and mixtures thereof, wherein the metal layer has a thickness of from about 5 nm to about 50 nm; and (b) galvanizing said steel strip by dipping it in a bath comprising molten zinc.

28. The process according to claim 27 carried out for a period of from about 1 second to about 100 seconds, at a temperature of from about 15° C. to about 100° C., in an aqueous solution having a pH of from about 0 to about 7.

29. The process according to claim 28 wherein the preparation of said steel strip for fluxing and continuous galvanization comprises the steps of:

(a) degreasing said steel strip by dipping it in alkaline solution; and (b) pickling said steel strip by dipping it in acid solution.

30. A process for a continuous galvanization comprising the steps of:

a) fluxing a steel strip by electroless plating on the surface of said strip a layer of metal from a fluxing solution comprising a mixture of copper and tin, wherein the percent of copper is from about 0% to about 20% by weight of the flux bath; and b) galvanizing said steel strip by dipping it in a bath comprising molten zinc.

31. The process according to claim 30 wherein the metal layer is deposited from an aqueous solution comprising hydrochloric acid, cupric chloride and stannous chloride.

32. The fluxing process according to claim 31 carried out for a period of from about 1 second to about 20 seconds, at a temperature of from about 20° C. to about 80° C., in an aqueous solution having a pH of from about 0 to about 4.

33. The process according to claim 32 wherein the percent of copper is from about 0% to about 2% by weight of the flux bath.

34. The process according to claim 8, wherein the layer of copper and tin has a thickness of from about 5 nm to about 50 nm.

* * * * *